US005943989A

United States Patent [19]

Kira

[11] Patent Number: 5,943,989

[45] Date of Patent: Aug. 31, 1999

[54] VALVE TIMING CONTROL DEVICE

[75] Inventor: Naoki Kira, Anjo, Japan

[73] Assignee: Aisin Seiki Kabushiki Kaisha, Aichi-pref., Japan

[21] Appl. No.: 09/092,017

[22] Filed: Jun. 5, 1998

[30] Foreign Application Priority Data

Jun. 5, 1997 [JP] Japan ..... 9-148298

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,666,914 | 9/1997 | Usida et al. | 123/90.17 |
| 5,724,929 | 3/1998 | Mikame et al. | 123/90.31 |
| 5,738,056 | 4/1998 | Mikame et al. | 123/90.17 |
| 5,775,279 | 7/1998 | Ogawa et al. | 123/90.17 |
| 5,794,577 | 8/1998 | Kira | 123/90.17 |
| 5,797,361 | 8/1998 | Mikame et al. | 123/90.17 |

FOREIGN PATENT DOCUMENTS

| | | |
|---|---|---|
| 1-92504 | 4/1989 | Japan . |
| 2-50105 | 4/1990 | Japan . |
| 9-60508 | 3/1997 | Japan . |
| 10-47022 | 2/1998 | Japan . |

*Primary Examiner*—Weilun Lo
*Attorney, Agent, or Firm*—Hazel & Thomas, P.C.

[57] ABSTRACT

A valve timing control device for controlling the opening/closing timing of the intake valve or exhaust valve of an internal combustion engine is disclosed, comprising a valve opening/closing rotary shaft rotatably assembled with the cylinder head of the internal combustion engine; a rotation transmitting member mounted around the rotary shaft so as to rotate relative thereto within a predetermined range for transmitting a rotating power from a crank pulley; vanes provided on the rotary shaft are the rotation transmitting member; a fluid chamber formed between the rotary shaft and the rotation transmitting member and halved into advancing chambers and delaying chambers by the vanes; first fluid passages for feeding and discharging a fluid to and from the advancing chambers; second fluid passages for feeding and discharging the fluid to and from the delaying chambers; a refuge hole formed in the rotation transmitting member or the rotary shaft and accommodating therein a lock pin spring-biased toward the rotary shaft or the rotation transmitting member; a fitting hole formed in the rotary shaft or the rotation transmitting member for fitting therein the head portion of the lock pin when the rotary shaft and the rotation transmitting member are synchronized in predetermined relative phases; and a third passage for feeding and discharging the fluid to and from the fitting hole, wherein the fluid is a working oil and a back pressure chamber formed in the refuge hole at the back of the lock pin is given communication with the inside of the cylinder head of the internal combustion engine via a communication passage formed in the rotation transmitting member or the rotary shaft.

2 Claims, 4 Drawing Sheets

VALVE TIMING CONTROL DEVICE

BACKGROUND OF THE INVENTION

1. Field of the Invention

The present invention relates to a valve timing control device to be used for controlling the opening/closing timing of an intake valve or an exhaust valve in a valve actuating mechanism of an internal combustion engine.

2. Description of the Related Art

In Unexamined Published Japanese Patent Application No. 1-92504 or Unexamined Published Japanese Utility Model Application No. 2-50105, for example, there is disclosed a valve timing control device of that kind, comprising: a rotation transmitting member so mounted around a valve opening/closing rotary shaft (including a cam shaft and an internal rotor integrally mounted on the cam shaft) rotatably assembled with the head of an internal combustion engine so as to rotate relative thereto within a predetermined range for transmitting a rotating power from a crank pulley; vanes provided on the rotary shaft; a fluid chamber formed between the rotary shaft and the rotation transmitting member and halved into advancing chambers and delaying chambers by the vanes; first fluid passages for feeding and discharging a fluid to and from the advancing chambers; second fluid passages for feeding and discharging the fluid to and from the delaying chambers; a refuge hole formed in the rotation transmitting member and accommodating therein a lock pin spring-biased toward the rotary shaft; a fitting hole formed in the rotary shaft for fitting therein the head portion of the lock pin when the rotary shaft and the rotation transmitting member are synchronized in predetermined relative phases; and a third passage for feeding and discharging the fluid to and from the fitting hole.

The valve timing control device, as described in each of the above-cited patent applications is constructed such that the lock pin is moved against the spring-urging force by the fluid fed to the fitting hole via the third fluid passage. Imagining the case in which the fluid fed to the fitting hole partially leaks through the clearance between the refuge hole and the lock pin to the back pressure chamber accommodating a spring for urging the lock pin, therefore, the back pressure chamber is vented to the atmosphere so that the fluid may be discharged therefrom.

Here, the fluid to be used in the device is a working oil. When the rotating power from the crank pulley is transmitted through a timing chain to the rotation transmitting member, the working oil to be discharged from the back pressure chamber can be employed as the oil for lubricating the timing chain. When the rotating power is transmitted through a timing belt made of a resin or rubber, the working oil may cause a slipping engagement between the timing belt and the rotation transmitting member or may deteriorate the timing belt.

In order to solve these problems, we have proposed a device capable of discharging the working oil properly from the back pressure chamber, as disclosed in Japanese Patent Application No. 8-202288. This device enables to avoid those problems by causing the third fluid passage to communicate with the advancing chambers or the delaying chambers (so as to use the advancing oil pressure or the delaying oil pressure as the oil pressure for releasing the lock pin) and by causing the back pressure chamber to communicate with the delaying chambers or the advancing chambers via a fourth fluid passage.

When the advancing oil pressure is employed as the releasing oil pressure in the device of Japanese Patent Application No. 8-202288, however, the discharge passage leading from the back pressure chamber through the delaying chamber to an oil reservoir is so long that a high load is required at the releasing time to start the phase transformations before the lock by the lock pin is completely released. When the delaying oil pressure is employed as the releasing oil pressure, on the other hand, the lock pin may advance into the fitting hole at the switching time from the most delayed position to the advancing state thereby to obstruct the phase transformations or to cause malfunction of the lock pin. With the construction in which the working oil is fed to the inside of the back pressure chamber, moreover, the lock pin may be finely vibrated in the axial direction to hit the outer circumference of the rotary shaft in the refuge hole by the pressure pulsations of the working oil thereby to cause the hammering.

SUMMARY OF THE INVENTION

The invention has been conceived to solve the above-specified problems. According to the invention, there is provided a valve timing control device for controlling the opening/closing timing of the intake valve or exhaust valve of an internal combustion engine, comprising a valve opening/closing rotary shaft rotatably assembled with the cylinder head of the internal combustion engine; a rotation transmitting member mounted around the rotary shaft so as to rotate relative thereto within a predetermined range for transmitting a rotating power from a crank pulley; vanes provided on the rotary shaft or the rotation transmitting member; a fluid chamber formed between the rotary shaft and the rotation transmitting member and halved into advancing chambers and delaying chambers by the vanes; first fluid passages for feeding and discharging a fluid to and from the advancing chambers; second fluid passages for feeding and discharging the fluid to and from the delaying chambers; a refuge hole formed in the rotation transmitting member or the rotary shaft and accommodating therein a lock pin spring-biased toward the rotary shaft or the rotation transmitting member; a fitting hole formed in the rotary shaft or the rotation transmitting member for fitting therein the head portion of the lock pin when the rotary shaft and the rotation transmitting member are synchronized in predetermined relative phases; and a third passage for feeding and discharging the fluid to and from the fitting hole, wherein the fluid is a working oil, and a back pressure chamber formed in the refuge hole at the back of the lock pin is given communication with the inside of the cylinder head of the internal combustion engine via a communication passage formed in the rotation transmitting member or the rotary shaft.

In the valve timing control device according to the invention, the working oil, as having leaked into the back pressure chamber through the clearance between the refuge hole and the lock pin can be discharged to the inside of the cylinder head via the communication passage. As a result, the working oil can be prevented from wetting the timing belt thereby to suppress a poor engagement between the rotation transmitting member and a timing belt and the premature deterioration of the timing belt even if the timing belt is made of a resin or rubber and adopted as means for transmitting the rotating power from a crank pulley to the rotation transmitting member. Since no working oil under pressure is fed to the inside of the back pressure chamber, moreover, neither a malfunction of the lock pin nor a fine vibration of the lock pin occurs so that the lock timing by the lock pin can be tuned by changing a spring force for urging the lock pin.

BRIEF DESCRIPTION OF THE DRAWINGS

FIG. 4 is a view similar to FIG. 2 but shows a state in which the internal rotor and the vanes are slightly rotated clockwise from the state of FIG. 2 relative to the external rotor and so on;

FIG. 7 is a view similar to FIG. 4 but shows a state in which the internal rotor and the vanes are rotated clockwise to a predetermined extent from the state of FIG. 4 relative to the external rotor and so on.

DESCRIPTION OF THE PREFERRED EMBODIMENTS

One embodiment of the invention will be described with reference to the accompanying drawings.

Figure 1:
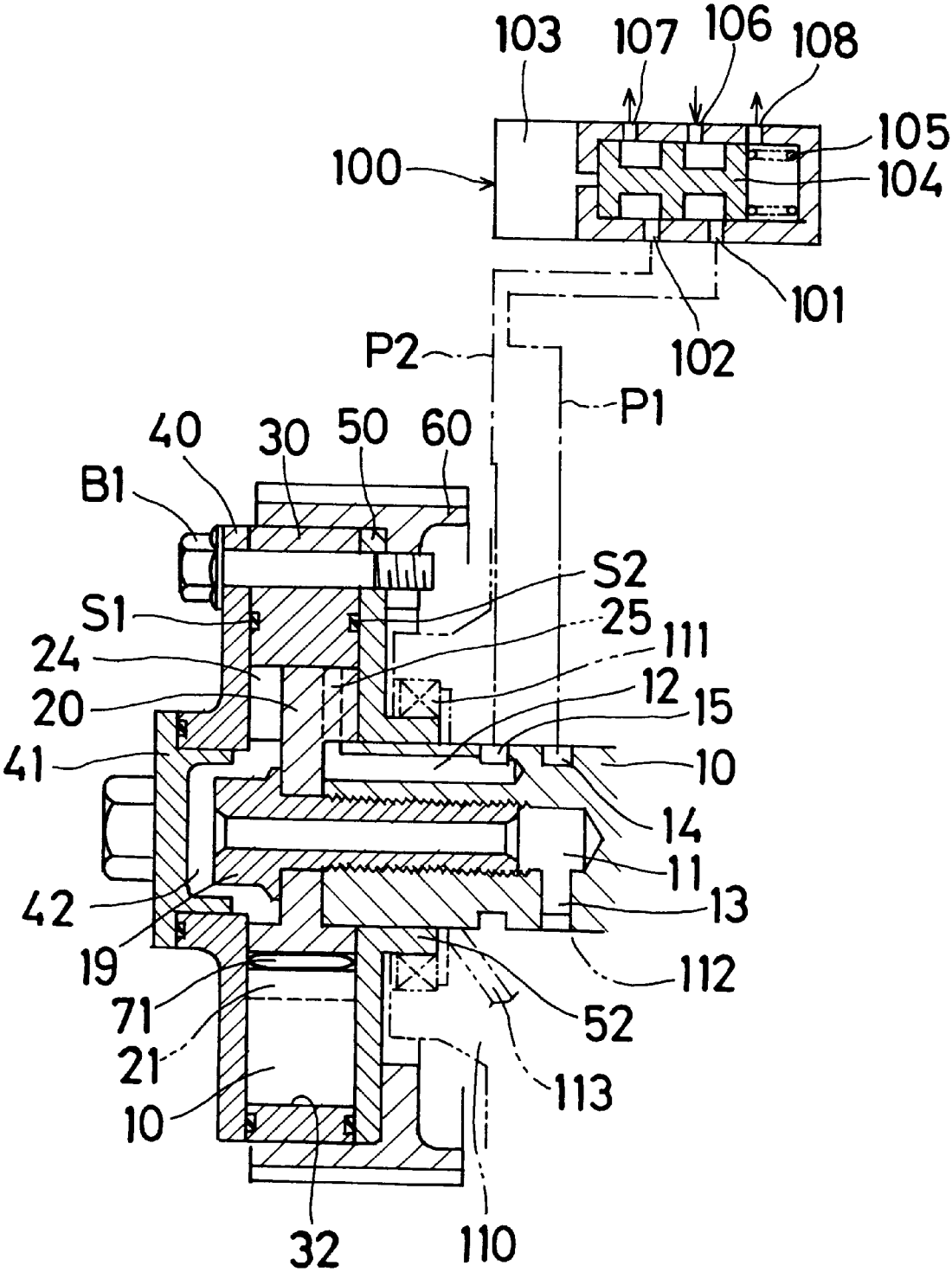
FIG. 1 is a longitudinal section schematically showing one embodiment of a valve timing control device according to the invention.
Figure 2:
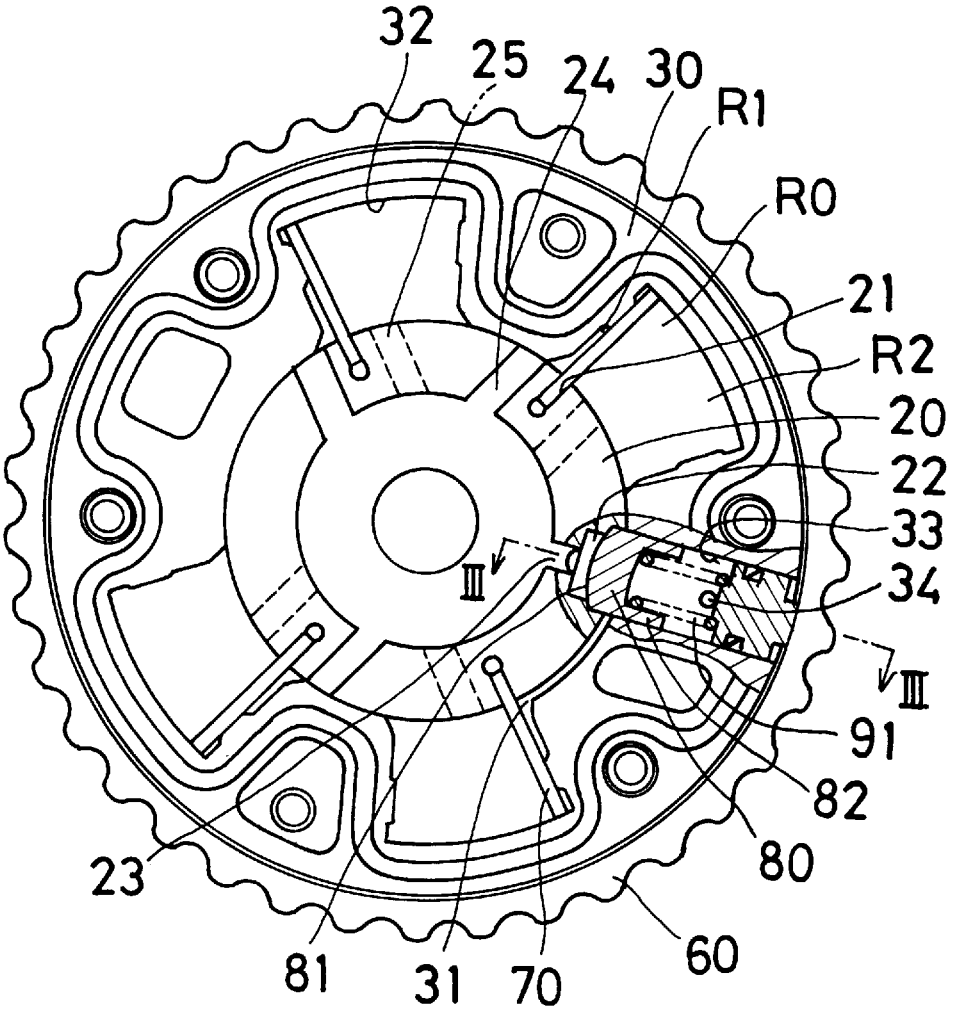
FIG. 2 is a partially broken front view showing the relation among an internal rotor, an external rotor, vanes, a lock pin, a timing pulley and so on, as shown in FIG. 1.
Figure 3:
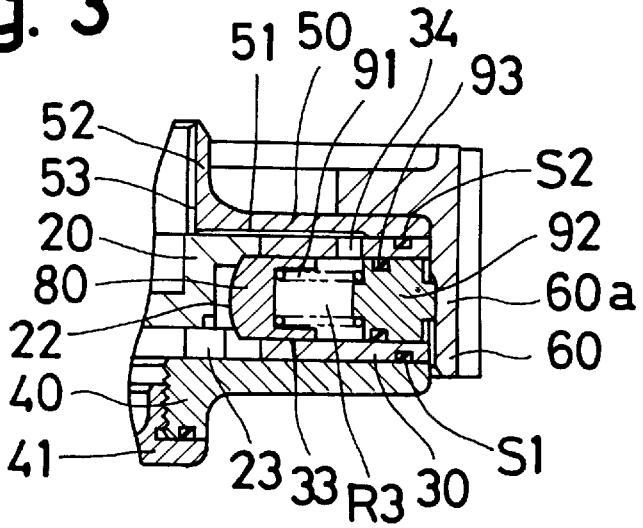
FIG. 3 is a section taken along line 3—3 of FIG. 2.

A valve timing control device according to the invention, as shown in FIGS. 1 to 3, is constructed so as to comprise a valve opening/closing shaft including a cam shaft 10 rotatably supported by a cylinder head 110 of an internal combustion engine, and an internal rotor 20 integrally provided on the leading end portion of the cam shaft 10; a rotation transmitting member mounted around the rotary shaft as to rotate relative thereto within a predetermined range and including an external rotor 30, a front plate 40, a cap 41, a rear plate 50 and a timing pulley; four vanes 70 assembled with the internal rotor 20; and a lock pin 80 assembled with the external rotor 30. Here, the timing pulley 60 is constructed, as well known in the art, to transmit the rotating power clockwise of FIG. 2 from the crank pulley through a timing belt of a resin or rubber (although both are not shown).

The cam shaft 10 is equipped with the well-known cam (not shown) for opening/closing an intake valve or an exhaust valve (not shown) and is provided therein with an advance passage and a delay passage, which are extended in the axial direction of the cam shaft 10. The advance passage 11 is connected to a connection port 101 of a change-over valve 100 via a radial passage 13, an annular passage 14 and a connection passage P1. On the other hand, the delay passage 12 is connected to a connection port 102 of the change-over valve 100 via an annular passage 15 and a connection passage P2.

The change-over valve 100 is enabled to move the spool 104 rightward of FIG. 1 against the action of a spring 105 by energizing a solenoid 103. The change-over valve 100 is so constructed as to establish, when deenergized, the communication between a feed port 106, as connected to an oil pump (although not shown) to be driven by the internal combustion engine, and the connection port 101 and the communication between the connection port 102 and an exhaust port 107 and as to establish, when energized, the communication between the feed port 106 and the connection port 102 and the communication between the connection port 101 and an exhaust port 108. As a result, the working oil is fed to the advance passage 11, when the solenoid 103 is deenergized, and to the delay passage 12 when the same is energized.

The internal rotor 20 is integrally fixed in the cam shaft 10 by means of a hallow bolt 19 and is provided with vane grooves 21 for mounting the four vanes 70 individually in the radial directions. Further provided are a fitting hole 22 for fitting the head portion 81 of the lock pin 80 to a predetermined extent in the state shown in FIG. 2, where the cam shaft 10, the internal rotor 20 and the external rotor 30 are synchronized in a predetermined phase (or the most delayed position) relative to one another; a passage 23 for feeding/discharging the working oil to and from the fitting hole 22 via the advance passage 11; passages 24 for feeding/discharging the working oil to and from advancing chambers R1 (excepting that, as located at the right-hand lower one of FIG. 2), as defined by the individual vanes 70, via the advance passage 11; and passages 25 for feeding/discharging the working oil to and from delaying chambers R2. as defined by the individual vanes 70, via the delay passage 12. To and from the advancing chamber R1 located at the right-hand lower position of FIG. 2, there is fed and discharged the working oil from the fitting hole 22 via a passage 31 formed in the external rotor 30. The fitting hole 22 is stepped to have a larger diameter at its outer end portion for receiving the head portion 81 of the lock pin 80 such that the top of the head portion 61 abuts against the step. For this, the diametrically larger portion is chamfered at its outer end. Here, each vane 70 is urged radially outward by a spring 71 (as shown in FIG. 1) fitted in the bottom portion of the vane groove 21.

The external rotor 30 is so assembled with the outer circumference of the internal rotor 20 as to rotate relative thereto within a predetermined range. To the two sides of the external rotor 30, there are joined the front plate 40 and the rear plate 50 through seam members S1 and S2. The external rotor 30 is integrally joined to the internal rotor 20 together with the timing pulley 60 by means of a bolt B1. With the front plate 40, the cap 41 is assembled liquid-tight to form a passage 42 for connecting the advance passage 11 of the cam shaft 10 and the passages 23 and 24 of the internal rotor 20. In the external rotor 30, on the other hand, there care formed a fluid pressure chamber R0 accommodating the individual vanes 70 and adapted to be halved into the advancing chambers R1 and the delaying chambers R2 by the individual vanes 70; and a refuge hole 33 formed in the radial direction of the external rotor 30 for accommodating the lock pin 80 and a spring 91 for urging the lock pin 80 toward the internal rotor 20.

The refuge hole 33 is closed liquid-tight at its outer end by a plug 92 and a seal member 93 to form a back pressure chamber R3 at the back of the lock pin 80. This back pressure chamber R3 is in communication with the inside of the cylinder head 110, as shown in FIGS. 2 and 3, via a communication hole 34 formed in the external rotor 30 and communicating with the back pressure chamber R3, a communication groove 51 (which can be exemplified by a communication hole) formed in the rear plate 50 and communicating with the communication hole 34 at its radially outer end, a communication groove 53 (which can be exemplified by a communication hole) formed axially in the inner circumference of a boss portion 52 (i.e., the portion which is rotatably assembled at its inner circumference with the cam shaft 10 and engaging at its outer circumference with an oil seal 111 assembled with the cylinder head 110) of the rear plate 50, and a communication hole 113 formed in a cam shaft supporting portion 112 of the cylinder head 110. Here, the port of the communication hole 34 at the side of the refuge hole is so arranged that it may not be shut by a skirted portion 82 of the lock pin 80 even when the lock pin 80 is moved against the urging force of the spring 80 by the working oil which is fed to the fitting hole 22 via the passage 23. On the other hand the plug 92 is prevented from coming out by the timing pulley 60.

The lock pin 80 is provided with the head portion 81 having a curved (or spherical) shape and the skirted portion 82, at which it is so fitted in the refuge hole 33 with a predetermined leakage clearance as to move radially of the external rotor 30, and is urged toward the internal rotor 20 by the spring 91. This enables the working oil to flow through the leakage clearance between the skirted portion 82 of the lock pin 80 and the refuge hole 33.

The valve timing control device thus constructed according to this embodiment is held in the locked state, where the internal combustion engine is stopped to stop the oil pump and to hold the change-over valve 100 in the state of FIG. 1 and where the head portion 81 of the lock pin 80 is fitted by a predetermined stroke into the fitting hole 22 to regulate the relative rotations of the internal rotor 20 and the external rotor 30, as shown in FIGS. 2 and 3, because the working oil is not fed from the change-over valve 100 to the advance passage 11 of the cam shaft 10 even if the internal combustion engine is started to drive the oil pump but if the solenoid 103 of the cam shaft 10 is energized substantially simultaneously with the start of the internal combustion engine. Here, even if the lock pin 80 is unable to come into the fitting hole 22 at the stop of the internal combustion engine by the misalignment of the refuge hole 33 and the fitting hole 22, the external rotor 30, the timing pulley 60 and so on are rotated clockwise of FIG. 2 because the pressure of the working oil of the advancing chambers R1 and the delaying chambers R2 is low at the start of the internal combustion engine, so that the internal rotor 20, the vanes 70 and so on are relatively rotated to the delay side to take the most delayed position whereas the lock pin 81 is pushed into the fitting hole 22 by the spring 91.

When the solenoid 103 of the change-over valve 100 is switched from the energized state to the deenergized state while the internal combustion engine is being run to drive the oil pump, on the other hand, the working oil is fed from the change-over valve 100 to the advance passage 11 of the cam shaft 10 so that it is fed via the passage 42 and the individual passages 24 to the individual advancing chambers R1, and from the passage 42 via the passage 23 to the fitting chamber 22. At the same time, the working oil is discharged to the outside from the individual delaying chambers R2 via the individual chambers 25, the delay passage 12, the change-over valve 100 and so on.

Figure 4:
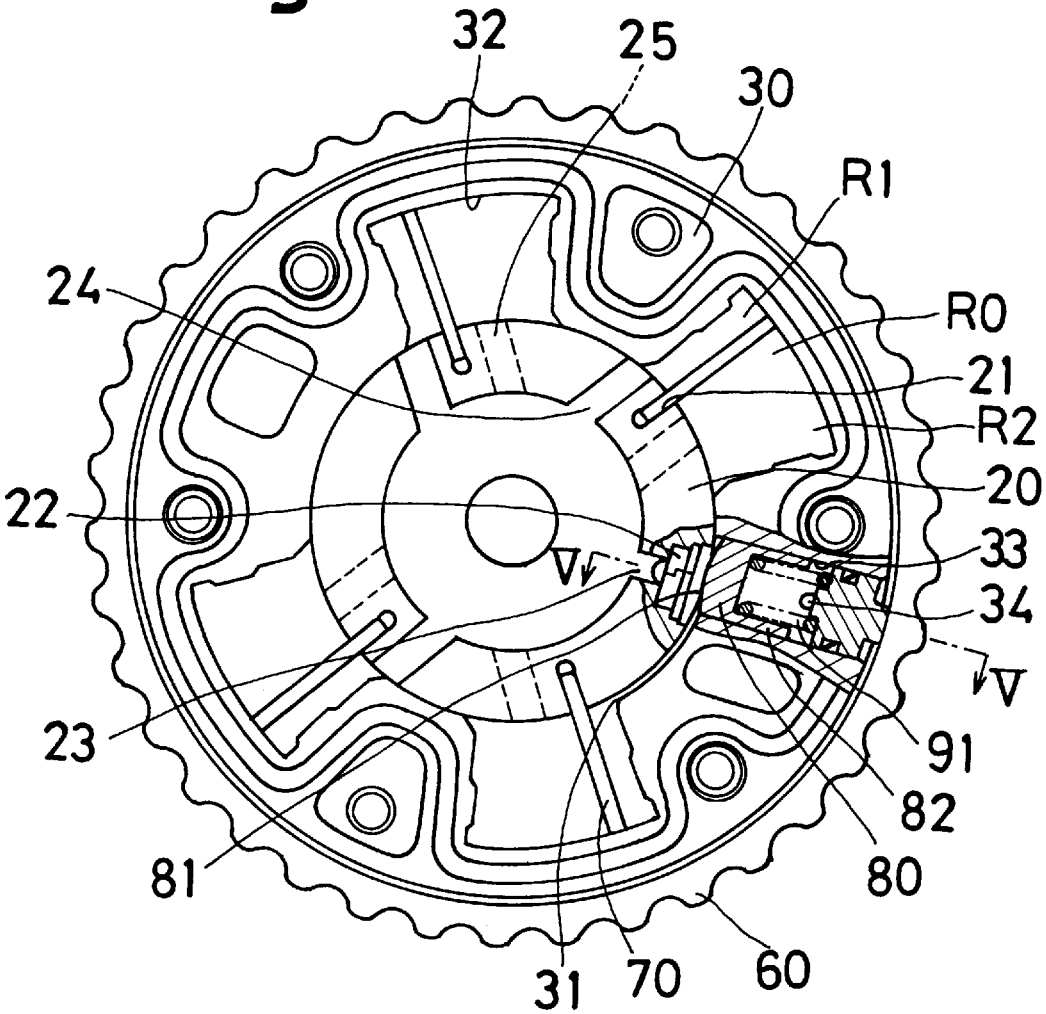
Figure 5:
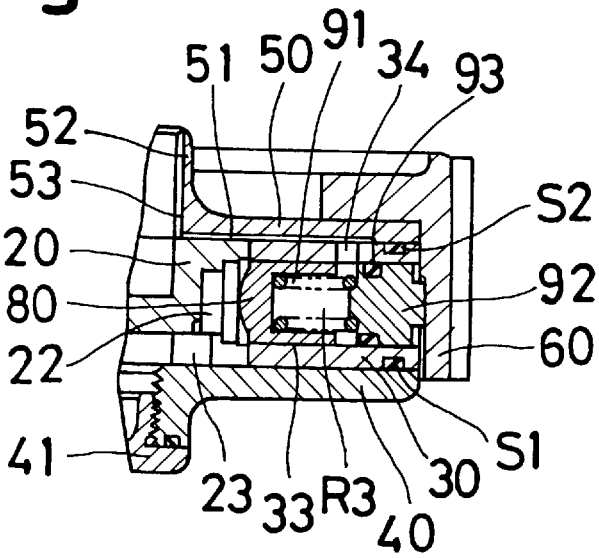
FIG. 5 is a section taken along line 5—5 of FIG. 4.

Here, as the working oil fed to the fitting hole 22 pushes the lock pin 80 against the spring 91, the lock pin 80 sequentially comes out of the fitting hole 22, and the rotary shaft side member including the cam shaft 10, the internal rotor 20 and the vanes 70 rotate relative to the rotation transmitting member including the external rotor 30 and the timing pulley 60, as shown in FIGS. 4 and 5. On the other hand, the working oil fed to the fitting hole 22 is fed to the advancing chamber R1, as located at the right-hand lower side, via the passage 31 formed in the external rotor 30.

In the state where the curved head portion 81 of the lock pin 80 is partially fitted in the fitting hole 22, as shown in FIGS. 4 and 5, the rotary shaft side member including the cam shaft 10, the internal rotor 20 and the vanes 70 are allowed to rotate relative to the rotation transmitting member including the external rotor 30 and the timing pulley 60, so that the relative rotations of the rotary shaft side member and the rotation transmitting member are started before the entirety of the head portion 81 of the lock pin 80 comes out of the fitting hole 22. As a result, the time period from the inflow of the working oil into the fitting hole 22 to the relative rotations of the rotary shaft side member and the rotation transmitting member can be shortened to improve the working response of the device.

Figure 6:
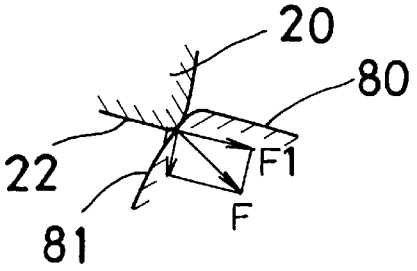
FIG. 6 is an enlarged section showing an essential portion of FIG. 4.

In the state where the head portion 81 of the lock pin 80 is partially fitted in the fitting hole 22, as shown in FIGS. 4 and 5, the lock pin 80 can be pushed to quickly come out of the fitting hole 22 not only by the working oil fed to the fitting hole 22 but also by a component F1 (as shown in FIG. 6) of the acting force F, which is established by the relative rotations of the rotary shaft side member and the rotation transmitting member and received by the lock pin 80. As a result, the working response of the device can also be improved to make a change in quick response from the state (or the most delayed state) shown in FIGS. 2 and 3 through the state shown in FIGS. 4 to 6 to the state (or the most advanced state) shown in FIGS. 7 and 8.

Figure 8:
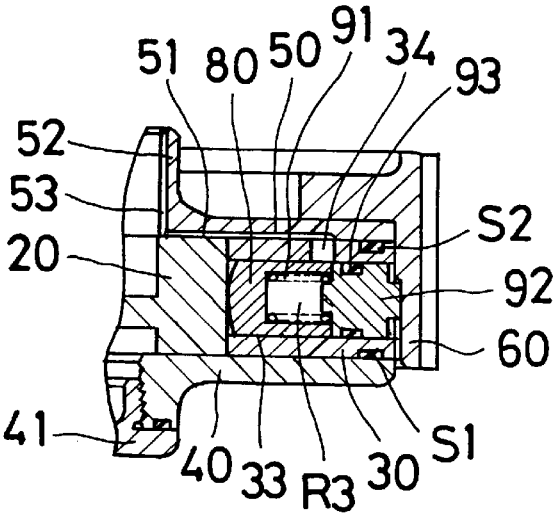
FIG. 8 is a section taken along line 8—8 of FIG. 1.
Figure 7:
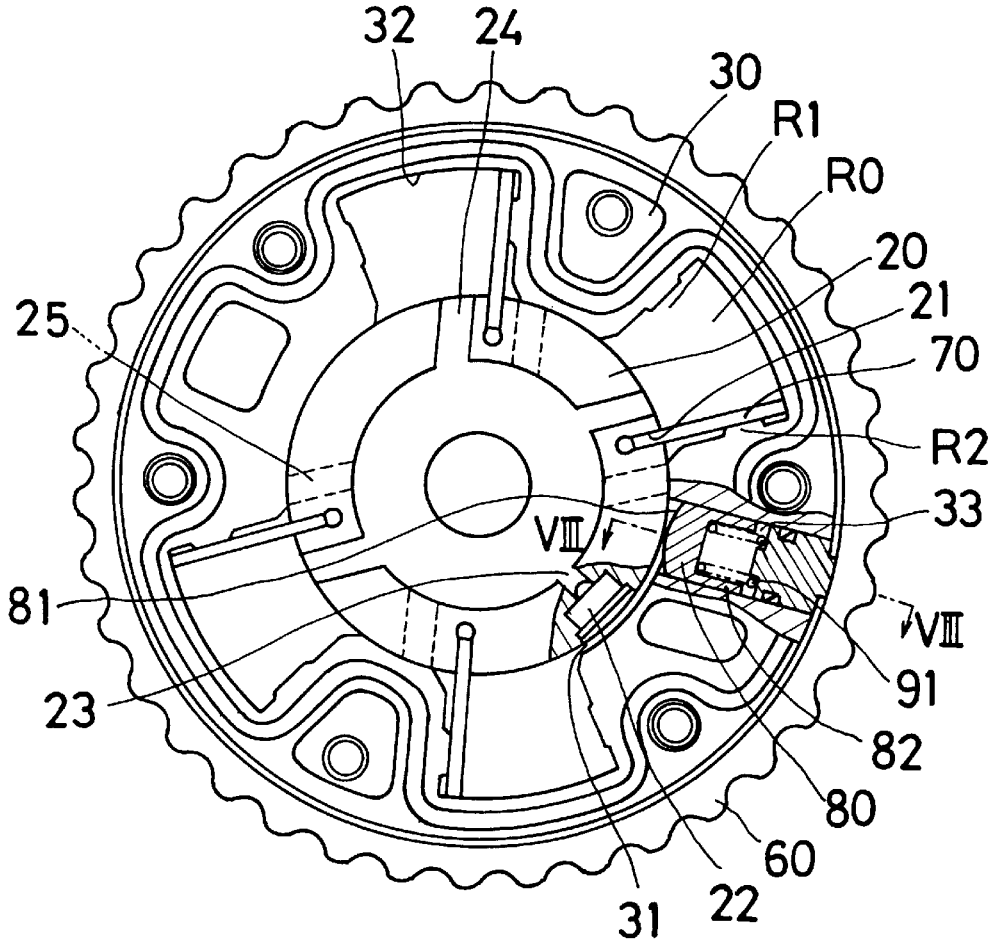

When the solenoid 103 of the changeover valve 100 is switched in the state of FIGS. 7 and 8 from the energized state to the deenergized state, the working oil is fed from the change-over valve 100 to the delay passage 12 of the cam shaft 10 so that it is fed via the individual passages 25 to the individual delaying chambers R2 and is discharged to the outside from the individual advancing chambers R1 via either the individual passages 24 or the passage 31, the fitting hole 22, the passage 23, the advance passage 11, the changeover valve 100 and so on. As a result, the rotary shaft side member including the cam shaft 10, the internal rotor 20 and the vanes 70 rotates relative to the rotation transmitting member including the external rotor 30 and the timing pulley 60 to bring the state from one shown in FIGS. 7 and 8 to one shown in FIGS. 2 and 3.

Here, in this embodiment, the working oil having leaked into the back pressure chamber R3 through the clearance between the refuge hole 33 and the lock pin 80 can be discharged into the cylinder head 110 via the communication passages (i.e., the passage hole 34 formed in the external rotor 30, the communication grooves 51 and 53 formed in the rear plate 50, and the communication hole 113 formed in the cam shaft supporting portion 112 of the cylinder head 110). This discharge makes it possible to suppress such a poor engagement between the timing pulley 60 and the timing belt and such a premature deterioration of the same belt as might otherwise be caused by the wetting of the working oil having leaked. Since the aforementioned communication passages can provide the shortest communication between the back pressure chamber R3 and the inside of the cylinder head 110, moreover, the passage resistance can be so lowered as to discharge the working oil having leaked into the back pressure chamber quickly and properly into the cylinder head 110 thereby to optimize the unlocking action of the lock pin 80.

Since the working oil under pressure is not fed to the inside of the back pressure chamber R3, on the other hand, the malfunction and the fine vibration of the lock pin 80 can be eliminated to tune the lock timing of the lock pin 80 by changing the force of the spring 91 for urging the lock pin 80. In this embodiment, moreover, the working oil is discharged via the communication groove 53 which is formed in the inner circumference of the boss portion 52 of the rear plate 50, so that the outer circumference of the cam shaft 10 and the inner circumference of the boss portion 52 of the rear plate 50 can be properly lubricated with that lubricating oil. Even if a communication groove corresponding to the communication groove 53 is practiced by forming it in the outer circumference of the cam shaft 10 or if the clearance between the outer circumference of the cam shaft 10 and the inner circumference of the boss portion 52 is enlarged, it is possible to expect effects similar to those of the foregoing embodiment.

In accordance with the above embodiment, the plug 92 having the seal member 93 fit in an outer circumferential groove thereof is fixed at the outer end of the refuge hole 33 so as to fluid-tightly close the outer end of the refuge hole 33. Since one end of the spring 91 biasing the lock pin 80 is engaged with plug 92, the plug 92 is in contact with an inner surface of a cylinder portion 60a of the timing pulley 60 covering an outer surface of the external rotor 30 in order that the plug 92 is prevented from falling out of the refuge hole 33.

Alternatively, when the plug 92 is snugly fit into the refuge hole 33 or the plug 92 is in contact with a snap ring or a C-ring which are fit into an inner circumferential groove disposed on an inner circumferential surface of the refuge hole 33 in order to prevent the plug 92 from falling out of the refuge hole 33 instead of the above construction, the valve timing control device is inconvenient to assemble, the number of parts of the valve timing control device becomes large and the inner circumferential groove of the refuge hole 33 must be machined.

Further, when the inner circumferential groove is disposed on the inner circumferential surface of the refuge hole 33, a cylindrical portion of the refuge hole 33 has to be enlarged in the axial direction thereof.

In accordance with the above embodiment, the plug 92 is easily prevented from falling out of the refuge hole 33 without the above inconveniences. Further, the cylindrical portion of the refuge hole 33 can be small in the axial direction thereof.

This embodiment has been practiced by providing the internal rotor 20 with the vanes 70 and by accommodating the lock pin 80 and the spring 91 in the external rotor 30. Besides this practice, however, the invention can also be practiced by accommodating the lock pin and the spring in the internal rotor and by providing the external rotor with the vanes.

On the other hand, the embodiment has been constructed such that the head portion 81 of the lock pin 80 assembled with the external rotor 30 in the state (or the most delayed state of FIG. 2), where the advancing chambers R1 take the minimum capacity, is fitted in the fitting hole 22 of the internal rotor 20. However, the construction can be modified such that the head portion 81 of the lock pin 80, as assembled with the external rotor 30, is fitted in the fitting hole 22 of the internal rotor 20 in the state (or the most advanced state of FIG. 7) where the delaying chambers R2 take the minimum capacity.

In the embodiment, moreover, the passage 23 for feeding and discharging the working oil to and from the fitting hole 22 is given the communication with the passages 24 leading to the advancing chambers R1. However, the invention can be practiced such that the passage 23 is given communication with the passage 25 leading to the delaying chambers R2. In this modification, the communication passages for providing the communication of the back pressure chamber R3 with the inside of the cylinder head 110 are equipped with orifices for delaying the return of the lock pin 80 to the locking side thereby to establish a time lag for transforming the phase before the lock pin 80 is fitted in the fitting hole 22, so that the lock pin 80 can be prevented during the running of the engine from being fitted in the fitting hole 22. Specifically, the lock pin 80 is pushed by the urging force of the spring 91 into the fitting hole 22 to regulate the relative rotations of the internal rotor 20 and the external. Rotor 30, when the vanes 70 come to the most delayed position in accordance with the rotation of the timing pulley 60 or when the vanes 70 are at the most delayed position to stop the engine while a sufficient oil pressure is not being fed at the start of the engine from the change-over valve 100. As a result, the switching response during the normal run of the engine can be shortened, and the hammering, as might otherwise be caused by the vanes 70 abutting against the side walls of the fluid pressure chambers R0, can be prevented when the fluid pressure chambers R0 are not sufficiently filled up with the pressure oil due to the leakage of the internal working oil after the engine stop.

In the foregoing embodiment, on the other hand, the advance passage 11 is connected to the connection part 101 of the changeover valve 100, and the delay passage 12 is connected to the connection port 102 of the change-over valve 100. In order that the delay passage 12 may be fed with the working oil from the not-shown oil pump, while the solenoid 103 of the change-over valve 100 is deenergized, and that the advance passage 11 may be fed with the same working oil while the same is energized, however, the advance passage 11 can be connected with the connection port 102 of the change-over valve 100, and the delay passage 12 can be connected to the connection port 101 of the change-over valve 100.

While the invention has been described in detail and with reference to specific embodiments thereof, it will be apparent to one skilled in the art that various changes and modifications can be made therein without departing from the spirit and scope thereof.

What is claimed is:

1. A valve timing control device for controlling the opening and closing timing of an intake valve or an exhaust valve of an internal combustion engine, comprising:

a valve opening and closing rotary shaft assembly rotatably assembled with a cylinder head of the internal combustion engine, the rotary shaft assembly including an end portion which is located outside of the cylinder head;

a rotation transmitting member mounted around the end portion of said rotary shaft assembly so as to rotate relative thereto within a predetermined range for transmitting rotating power from a crank pulley via a timing belt that is made of a resin or a rubber;

vanes provided on one of said rotary shaft assembly and said rotation transmitting member;

a fluid chamber formed between said rotary shaft assembly and said rotation transmitting member and divided into advancing chambers and delaying chambers by said vanes;

first fluid passages for feeding and discharging a fluid to and from said advancing chambers;

second fluid passages for feeding and discharging the fluid to and from said delaying chambers;

a refuge hole formed in one of said rotation transmitting member and said rotary shaft assembly, and for accommodating therein a lock pin spring-biased toward the other of said rotary shaft assembly and said rotation transmitting member;

a fitting hole formed in the other of said rotary shaft assembly and said rotation transmitting member for fitting therein a head portion of said lock pin when said rotary shaft assembly and said rotation transmitting member are synchronized in predetermined relative phases; and a third fluid passage for feeding and discharging the fluid to and from said fitting hole, wherein said fluid is a working oil, and a back pressure chamber formed in said refuge hole at a back of said lock pin and that communicates with an inside of the cylinder head of the internal combustion engine via a communication passage formed in one of said rotation transmitting member and said rotary shaft assembly.

2. A valve timing control device according to claim 1, wherein said rotary shaft assembly further includes a cam shaft rotatably supported by said cylinder head, and an internal rotor integrally mounted on a leading end portion of said cam shaft, said rotation transmitting member includes an external rotor for accommodating said internal rotor, a front plate, a rear plate, and a timing pulley integrally mounted on an outer circumference of said external rotor, said refuge hole is formed in said external rotor, said rear plate is rotatably supported at its inner circumference by said cam shaft, and said communication passage includes a first passage formed in said external rotor and communicating with said back pressure chamber, a second passage formed in said rear plate and communicating with said first passage, and a third passage formed between said rear plate and said cam shaft for providing communication between said second passage and the inside of said cylinder head.

* * * * *